United States Patent [19]

Marone

[11] 3,991,635

[45] Nov. 16, 1976

[54] ADJUSTABLE EXTRACTION PLIERS

[76] Inventor: Thomas E. Marone, 109 Cherry Lane, Boonton, N.J. 07005

[22] Filed: Mar. 4, 1976

[21] Appl. No.: 663,874

[52] U.S. Cl. ..... 81/420; 29/268

[51] Int. Cl.[2] ..... B25B 7/02

[58] Field of Search ..... 81/420, 418, 5.1; 29/268

[56] References Cited

UNITED STATES PATENTS

| | | | |
|---|---|---|---|
| 2,187,929 | 1/1940 | Blanc | 81/5.1 R |
| 2,342,479 | 2/1944 | Miles et al. | 81/5.1 R |
| 2,814,860 | 12/1957 | McCaleb | 29/268 |
| 3,826,160 | 7/1974 | Allen et al. | 81/418 |

*Primary Examiner*—James L. Jones, Jr.
*Attorney, Agent, or Firm*—James J. Cannon, Jr.; James J. Cannon

[57] ABSTRACT

An adjustable pliers-like tool, for the extraction of hollow wall toggle bolt fasteners, having substantially rectangular antipodal flat jaw plates, the lower jaw having a forked notch therein. Each jaw is integrated with and positioned by a pair of movable, flat linearly extending handles having means to provide adjustability to vary the range of jaw movement. The handle of the lower forked jaw extends perpendicularly from the upper surface thereof and forms an obtuse angle with respect to the jaw plate. The upper jaw handle extends substantially parallel beyond the upper surface of the upper jaw plate and then angles acutely upwards with respect to the upper jaw plate, both handles being substantially parallel in assembled form. The tool is designed to straighten out retracted toggle bolt arms to allow removal of the toggle bolt assembly.

4 Claims, 3 Drawing Figures

ADJUSTABLE EXTRACTION PLIERS

BACKGROUND OF THE INVENTION

The present invention relates to a special purpose pliers-like toggle bolt extraction tool having antipodal jaws, one jaw having a forked notch therein, positioned by a pair of angular movable handles, the handles further having means to vary the range limits of jaw movement.

DESCRIPTION OF THE PRIOR ART

The inventor has no knowledge of the existence of any specialized tool for the removal of hollow wall fasteners, commonly known as toggle bolts, other than the tool of the present invention. The tool of the present invention does not necessarily reduce the absolute number of tools necessary to remove the toggle bolt fasteners, but the tool does substantially simplify and make the removal more efficient while protecting the surface of the wall, in which the bolt is secured, from further damage during removal.

Removal of a toggle bolt fastener entails straightening out the integrated expanded fastener arms from their retracted fixed position abutting a wall. This operation has previously been accomplished, for example, by backing the screw out of the encompassing threaded retaining fastener portion; and by using a hammer to pound upon the head of the screw to drive it towards the wall and straighten the expanded arms.

The possibility of striking the screw too hard, thereby forcing the toggle flange and screw into the wall, creates the potential of further damage to the wall especially if the wall is of a soft substance such as wallboard. Another problem connected with the first problem arises, especially upon a hard irregular surface, whereby the toggle flange may become jammed in the wall and thus difficult to pry away and remove.

Accordingly the present invention envisions a pliers like tool designed to fluidly reverse the mounting procedure to effect the straightening of the expanded toggle bolt fastener arms by means of the tool through the grip of an operator's hand. The tool protects the surface of the wall from further marring and eliminates the possibility of the toggle flange jamming in the wall. The tool further provides a means to remove the entire toggle bolt fastener in basically one operation, the removal of which previously required the operation of a hammer and some sort of gripping pliers, none of which have proven extremely effective.

SUMMARY OF THE INVENTION

The adjustable hollow wall toggle bolt extraction pliers-like tool of the present invention is comprised of two distinct movably secured complimentary components. Each component has two distinct members, a handle-lever member and a jaw member.

One component is characterized by a substantially rectangular jaw member, which is a flat plate, and a perpendicularly affixed, flat linearly extending handle-lever member. The handle portion eminates vertically from the surface of one end of the jaw plate for a distance and then abruptly angles obtusely with respect to an horizontal plane formed by the jaw plate. This jaw plate itself is characterized by a V-shaped fork within the end opposing the handle end. The vertical portion of the handle contains a longitudinal slot, through which a securing pivot pin fits, to provide adjustability.

The other component is characterized by a substantially rectangular flat plate jaw member and an integrated flat handle member. The handle is affixed perpendicularly and runs the length of the plate. Thereafter the handle extends beyond the plate for a distance in a plane parallel a the horizontal plane formed by the plate and then angles acutely with respect to a horizontal plane.

In operation, the jaw plate having the V-shaped fork is slipped between a loosened toggle fastener flange and the wall and the other jaw plate is placed against an already backed-out screw. Manual pressure is applied to the handles, causing them to act as levers, thereby forcing the screw back into the wall which in turn causes the expanded fastener arms to straighten. This allows simple removal of the entire toggle bolt fastener assembly by simply retracting the extraction pliers perpendicularly from the wall, the flange and head of the screw being retained within the fork and between the operative surfaces of the jaws.

The present invention, therefore, provides a simple means to efficiently remove a toggle bolt fastener while effectively preventing any further damage to the wall. Further features of the present invention will become apparent from the following drawings and descriptions thereof.

DESCRIPTION OF THE DRAWINGS

Figure 1:
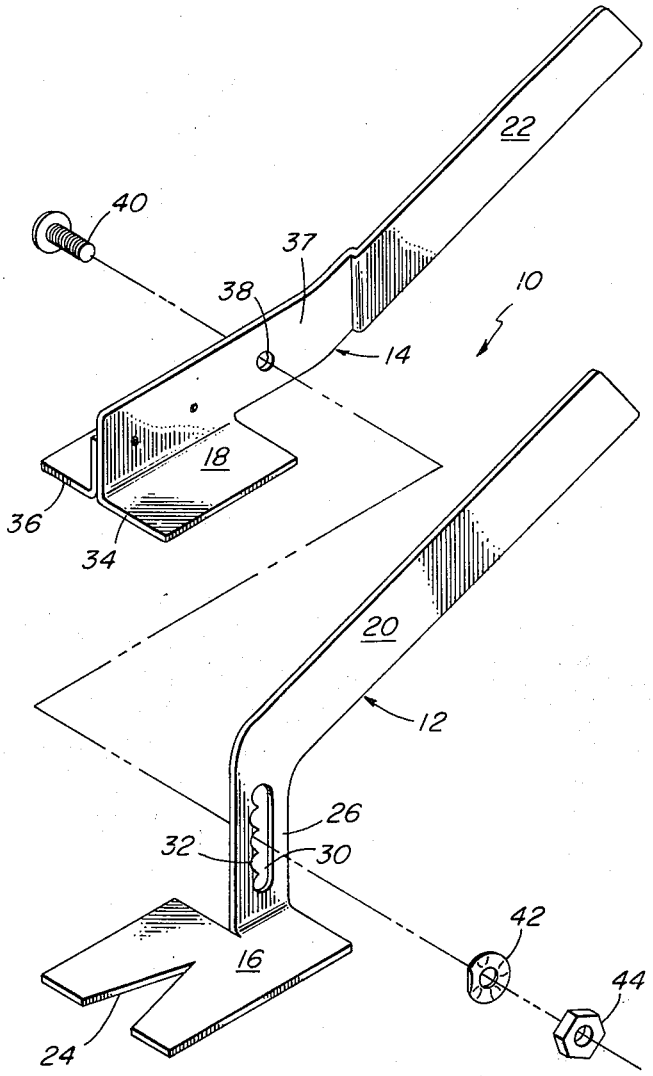
FIG. 1 illustrates an exploded view of the tool of the present invention and the components thereof.
Figure 2:
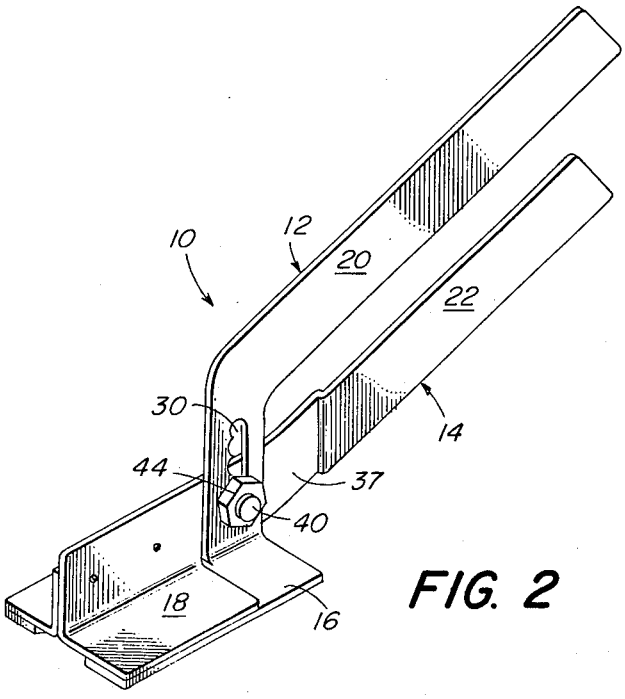
FIG. 2 illustrates a perspective view of the tool of FIG. 1 in assembled form.

Referring now to FIGS. 1 and 2, the unassembled and assembled views of the invention respectively, the pliers-like extraction tool of the present invention is generally designated by the reference numeral 10. It may be readily observed that tool 10 is comprised of two distinct components 12, 14, each component having a flat, substantially rectangular jaw plate member, designated 16 and 18 respectively, and each having a flat linearly extending handle member, designated 20 and 22 respectively. Pliers-like tool 10 may be constructed from stainless steel or any suitably strong metal or material. Components 12 and 14 could be produced by form molding one integrated piece or constructed as herein embodied and illustrated for essentially simple, sturdy and economical construction.

Component 12 is characterized by jaw plate member 16 which, on one end, has mediately positioned V-shaped symmetrical forked notch 24 which is capable of slipping over various sized toggle bolt flanges. The edges of fork 24 may be beveled, the desirability of which will become apparent in conjunction with FIG. 3. Jaw plate 16 is substantially rectangular, but as embodied, the lower portion of handle 20 is formed from a portion of the end of jaw plate 16 which opposes the end having forked notch 24. Flat handle 20 has a inner portion 26 rising vertically perpendicular to jaw plate 16. Inner vertical handle portion 26 further includes longitudinal slot 30 which has a plurality of notched ridges 32 which provide adjustability to various sized hollow wall toggle bolt fasteners. The lengths of vertical handle portion 26 and slot 30 are dependent upon the range of sizes of toggle bolts desired to be removed.

The remainder of handle 20, extending from inner vertical portion 26, abruptly angles obtusely with respect to a horizontal plane formed by jaw plate 16.

Component 14 is characterized by substantially rectangular flat jaw plate member 18 formed, as embodied, by two bent plates 34, 36 juxtaposed and suitably secured by rivets or other suitable means. Flat handle 22 eminates perpendicularly from one of the plates 34, 36 and forms a T shape with respect to jaw plate member 18. Inner handle portion 37 extends for a distance, substantially parallel to a horizontal plane formed by jaw plate 18. The length of portion 37 corresponds to the length of vertical inner handle portion 26. Handle 22 further has a bore 38 approximately at the midpoint of inner portion 37. The outer portion of handle 22 thereafter angles acutely with respect to a horizontal plane formed by jaw 18.

FIG. 2 illustrates assembled pliers-like extraction tool 10. Component 14 and upper jaw plate member 18 is positioned upon component 12 and lower jaw plate member 16. Keyed threaded pivot pin 40, lock washer 42 and nut 44 are used to secure components 12, 14 through bore 38 and slot 30 respectively. It can be readily observed that, due to the angular relations of the handles, the major outer gripping portions of handles 20 and 22 are substantially parallel. The angles formed by the gripping portions of handles 20 and 22 with respect to a horizontal plane should be between 15° and 30° for most efficient operation and handling. Thus handle 20 for lower jaw 16 is the upper handle and handle 22 for upper jaw 18 is the lower handle.

It should be noted that lower jaw plate 16 extends somewhat beyond upper jaw plate 18 to accommodate handle 20. The rear of jaw 18 abuts lower vertical handle portion 26 and is movable thereby. Also the flat surfaces of handles 20, 22 are slidable by each other.

Figure 3:
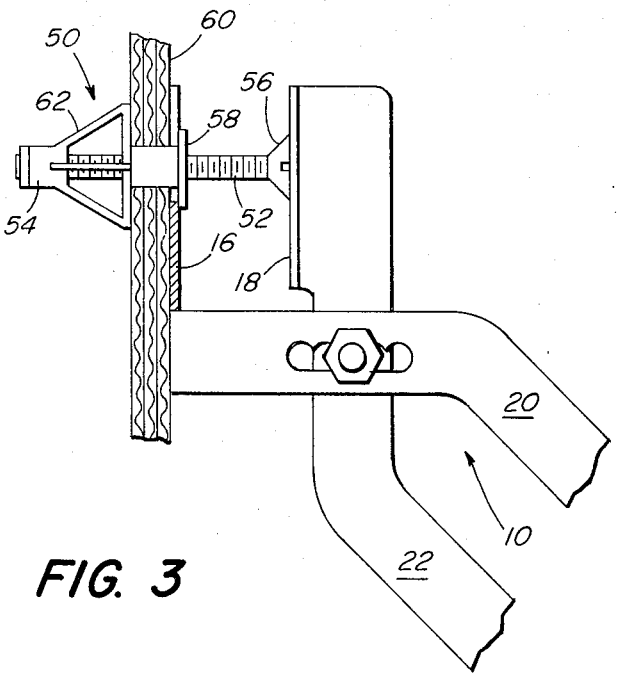
FIG. 3 illustrates the tool of FIGS. 1 and 2 in position to perform the extraction of a toggle bolt fastener.

FIG. 3 illustrates the removal of hollow wall toggle bolt fastener 50 through the use of the assembled tool 10 of FIG. 2. Before tool 10 may be used toggle bolt screw 52 must be backed out of the threaded neck portion 54 of fastener 50 approximately one-eighth inch by means of a screw driver. Screw head 56 thereafter should be tapped lightly by means of a hammer. This operation will retract the internal fastener portion enough to release flange 58 of fastener 50 from wall 60. Screw 52, by means of a screw driver, is backed further out of fastener 50 to an extent which allows minimum thread engagement between screw 52 and threaded fastener neck 54.

The toggle bolt assembly is now prepared for removal through the application of extraction tool 10 which in effect fluidly reverses the procedure of toggle bolt mounting. Tool 10 and antipodal jaws 16 and 18 are opened. Forked notch 24 of lower jaw 16 is inserted between fastener flange 58 and wall 60. Upper jaw plate 18 is then positioned to abut screw head 56. The operator manually closes jaws 16, 18 by bringing handles 20, 22 together, which act as levers, causing screw 52 to be forced back into the wall. This causes expanded fastener arms 62 to be retracted and thus straightened out to allow the removal of the fastener assembly. When this operation is completed screw head 56 and flange 58 will be snuggly secured between jaws 16 and 18. The operator will then simply move the tool perpendicularly from the wall to effect the removal.

It is readily obvious that if forked notch 24 is beveled, the insertion between fastener flange 58 and wall 60 will be effected more easily. Also it is desired that the thickness of jaw plates 16 and 18 be as thin as practically possible with suggested thickness ranging from one-sixteenth to one-eighth inch.

It should be noted that tool 10 could be applied to various extraction uses and may be embodied and constructed in various forms, such being simple design choices. The inventor, therefore, does not wish to be limited to the specific disclosure and criteria herein disclosed but only to the spirit and scope of the following claims.

I claim:

1. A pliers-like extraction tool for the removal of hollow wall toggle bolt fasteners comprising:

a pair of antipodal substantially rectangular jaw plates being upper and lower jaw plate members, having integrated angled flat surface handle-lever members extending from the upper surface thereof, each handle being pivoted and slidable by the flat surface of the other and cooperating in the operation of said antipodal jaws;

said lower jaw plate, having an handle end, extending somewhat beyond said upper plate to accommodate said integrated handle-lever;

said lower plate having a forked notch, mediately and symmetrically positioned on the plate end opposing said handle end, engageable upon a flange of said toggle bolt;

said upper plate angled handle member having an inner portion integrated longitudinally along said plate and extending substantially parallel to the plane of said plate and an outer portion angled acutely upwards from the horizontal plane of said plate;

said lower plate handle member being angled obtusely to the plane of said lower plate having an inner portion extending vertically from and perpendicularly to said lower plate and an outer portion angling upwards acutely from the horizontal plane of said jaw plate;

a bore mediately positioned in said inner portion of said upper jaw handle member;

a ridged longitudinal slot mediately positioned in said inner portion of said lower jaw plate handle member to provide adjustability; and pivot pin means to movably secure said handles.

2. The extraction tool of claim 1 wherein said inner handle portions of each handle are identical in length and wherein the acutely angled outer portions of each handle are of equal angles with respect to an horizontal plane formed by said antipodal jaw plates, the range of said angles being from 15° to 30°, said handle outer portions being parallel when said jaws are in a closed position.

3. The extraction tool of claim 1 wherein said forked notch is beveled.

4. A pliers-like extraction tool for the removal of hollow wall toggle bolt fasteners comprising;

a substantially rectangular, flat upper jaw plate having, in a perpendicular relation to said plate, an acutely angled integrated flat handle-lever member extending longitudinally along the surface of said jaw plate and having an inner portion extending beyond said jaw plate substantially parallel to the plane of said plate and an outer portion acutely angled upwards from the plane formed by said upper plate;

a substantially rectangular lower jaw plate extending, at its handle end, somewhat beyond said upper jaw plate and having a forked notch, mediately positioned within the opposing end, engageable upon a flange of said toggle bolt;

said lower jaw plate having an obtusely angled integrated flat handle member having an inner portion eminating vertically perpendicular to the upper surface of said plate;

a mediately positioned longitudinal ridged slot within said inner vertical portion of said lower jaw handle member;

a mediately positioned bore within the inner portion of said upper jaw plate handle member.

* * * * *